US005102437A

United States Patent [19]

Hirayama

[11] Patent Number: 5,102,437

[45] Date of Patent: Apr. 7, 1992

[54] MOUNTING FRAME FOR A FILTER DISPOSED AT THE FRONT OF THE CEILING IN A CLEAN ROOM

[75] Inventor: Shoji Hirayama, Yamato, Japan

[73] Assignee: Hirayama Setsubi Kabushiki Kaisha, Kanagawa, Japan

[21] Appl. No.: 742,528

[22] Filed: Aug. 7, 1991

Related U.S. Application Data

[63] Continuation of Ser. No. 554,458, Jul. 19, 1990, abandoned.

[51] Int. Cl.[5] ..... B01D 46/00

[52] U.S. Cl. ..... 55/494; 55/495; 55/502; 55/508; 55/523

[58] Field of Search ..... 55/385.2, 494, 495, 55/502, 508, 523

[56] References Cited

U.S. PATENT DOCUMENTS

| | | | |
|---|---|---|---|
| 3,360,910 | 1/1968 | Soltis | 55/508 |
| 4,600,419 | 7/1986 | Mattison | 55/508 |
| 4,601,737 | 7/1986 | Gerbig | 55/508 |
| 4,671,811 | 6/1987 | Cadwell, Jr. et al. | 55/494 |
| 4,678,487 | 7/1987 | Cadwell, Jr. et al. | 55/502 |
| 4,746,341 | 5/1988 | Komoda | 55/524 |
| 4,758,272 | 7/1988 | Pierotti et al. | 55/523 |
| 4,960,448 | 10/1990 | Zievers | 55/341.1 |

*Primary Examiner*—Jay H. Woo
*Assistant Examiner*—C. Scott Bushey
*Attorney, Agent, or Firm*—Oliff & Berridge

[57] ABSTRACT

By making a mounting frame for a filter disposed at the front of the ceiling in a clean room of a sintered metallic material, the mounting frame obtains a structure with a strength capable of supporting the filter and with an air filtering resistance comparable to that of the filter, thereby preventing standing air in the lower part of the mounting frame and solving the problem of lowered purity of air.

12 Claims, 1 Drawing Sheet

MOUNTING FRAME FOR A FILTER DISPOSED AT THE FRONT OF THE CEILING IN A CLEAN ROOM

This is a continuation of application Ser. No. 07/554,458 filed July 19, 1990, now abandoned.

BACKGROUND OF THE INVENTION

The present invention relates to a mounting frame for a filter disposed at the front of the ceiling in a clean room.

Conventionally various clean rooms with a sufficiently purified space have been used widely in producing precision instruments, electronic parts such as LSIs, medicines or others. Although various types of clean rooms are known to the public, a laminar downflow type wherein purified air is fed vertically from an air port disposed at the front of the ceiling into the room is generally employed. In this case, a super clean room is realized wherein purified air is fed through a filter disposed on the overall surface of the ceiling. Although the filter generally used in a super clean room has a good filtering capacity because of glass fiber bonded by means of a binder, the binder possesses not only a peculiar odor, but glass fiber corpuscles may flow into the room and scatter therein because of the deterioration of the binder associated with aging. The filter now in use has the above-mentioned disadvantages.

Since in a conventional clean room, the filter is fixed in a mounting frame hung from the ceiling, and since the circumference of the filter is sealed with a sealing compound, purified air cannot pass through the vicinity of the mounting frame, standing air is easily formed in the lower part of the mounting frame, and a vortex flow of floating dust is formed downstream of the mounting frame that may lower the purity of air.

It is an object of the present invention to provide a filter mounting frame which itself works as a filter and forms no standing air downstream thereof.

In order to attain said object, a filter mounting frame for a clean room is constructed of a hard material molding having a strength capable of supporting the filter and also having an air filtering resistance comparable to that of the filter according to the present invention.

For the mounting frame, materials having an air filtering resistance comparable to that of a high performance filter are used. Materials such as alumina or stainless sintered material, porous glass and FRP meet the requirement. By applying an air permeable sealing material to the stepped part of the mounting frame, in contact with the high performance filter, the overall front of the ceiling becomes a filter.

DESCRIPTION OF THE PREFERRED EMBODIMENTS

In the following, the present invention is described in detail with reference to the drawings.

Figure 1:
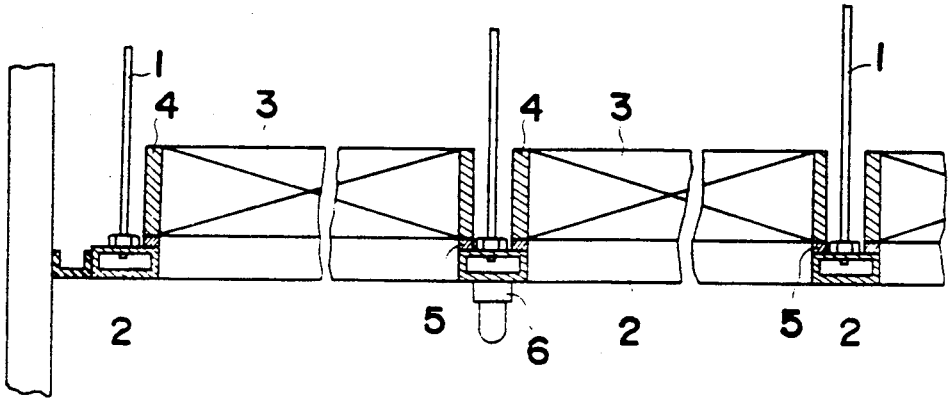
FIG. 1 is a sectional view of a clean room filter part using a filter mounting frame according to the present invention.

FIG. 1 shows one embodiment of the present invention, wherein hanging bolts 1 support mounting frames 2. High performance filters 3, 3 are provided between the mounting frames 2, 2. As a mounting frame 2, a square column-shaped hollow body made of air permeable alumina sintered material is used, but the cross-sectional shape thereof is not limited to that shown in the figure. Between the lower end face of the frame member 4 of the filter 3 and the upper face of the mounting frame an air permeable seal 5 is applied.

Figure 2:
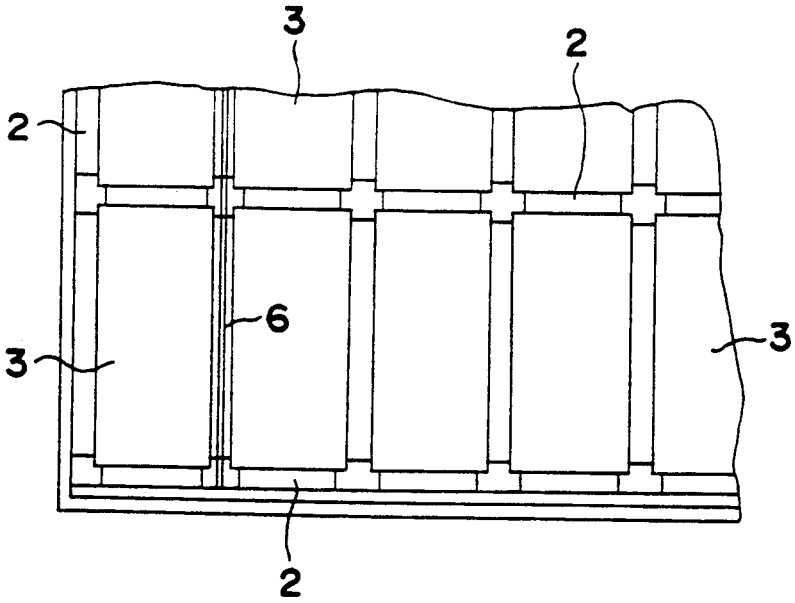
FIG. 2 is an upward looking view of the ceiling.

FIG. 2 is an upward looking view of the ceiling, and the overall ceiling including the filter 3. The mounting frame 2 and the seal material 5 are air permeable. No. 6 in the figure shows a fluorescent light provided at the mounting frame 2.

As described above, the air supplied from above passes through the overall front of the ceiling including the mounting frame, and only purified air will be blown into the clean room. As a result thereof, no standing air is formed in the lower part of the mounting frame, thereby using the overall front of the ceiling as a filter and maintaining a high purity of air.

In said embodiment, if a high performance filter preferably made of metal powder sinter is supported by a mounting frame made of air permeable sintered material, both the filter and the mounting frame will show the same expansion coefficient, resulting in a more reliable sealing than any seal, an increased air filterimg area, a reduced resistance, and a saved energy.

According to the present invention, as described above, since the filter mounting frame has a strength capable of supporting the filter, and since it is made of a hard material with an air filtering resistance comparable to that of the filter, not only the air filtering area can be increased substantially and the problem of the lowered air purity because of standing air in the lower part of the mounting frame can be solved, but also the overall ceiling can be used as a filter. By making the mounting frame of a hard material such as sintered metallic members dust and dirt can be removed by means of washing or so, thereby permitting a clean reuse thereof.

What is claimed is:

1. A filter apparatus for a clean room comprising:

a mounting frame made of an air permeable material, said mounting frame having at least two frame members disposed parallel to one another and at least two additional frame members disposed parallel one another and perpendicular to said at least two frame members, said at least two frame members and said at least two additional frame members intersecting to define at least one opening having a rectangular shape; and a filter element associated with said at least one opening;

said mounting frame having a filtering resistance comparable to a filtering resistance of the filter element to create a uniform filtered air flow area defined by the filter element and a perimeter of the at least two frame members and the at least two additional frame members.

2. A filter apparatus for a clean room as claimed in claim 1, wherein said mounting frame is made of a sintered metallic material.

3. A filter apparatus for a clean room as claimed in claim 1, said filter further comprising a seal between a lower end of an edge of said filter element and an upper surface of said frame members defining said at least one opening and supporting said associated filter element.

4. A filter apparatus for a clean room as claimed in claim 2, wherein said filter element comprises a metal powder sinter.

5. A filter apparatus for a clean room as claimed in claim 1, wherein said filter element comprises a metal powder sinter.

6. A filter apparatus for a clean room as claimed in claim 5, wherein all said frame members and said associated fliter elements have substantially the same coefficient of expansion.

7. A filter apparatus for a clean room as claimed in claim 1, wherein all said frame members and said associated filter elements have substantially the same permeability to air.

8. A frame for supporting filter units comprising:

a first set of at least two elongated frame members disposed parallel to one another;

a second set of at least two elongated frame members, said frame members of said second set disposed parallel to one another and perpendicular to said first set so as to define at least one rectangular opening having each corner delineated by an intersection of one frame member of said first set and one frame member of said second set, an upper surface of said frame members lying in one plane, all said frame members comprising an air permeable material having a filtering resistance comparable to a filtering resistance of the filter units to create a uniform filtered air flow area defined by at least one filter unit and a perimeter of the at least one opening defined by the first and second of frame members.

9. A frame as claimed in claim 8, wherein the frame further comprises means for suspension from a ceiling.

10. A frame as claimed in claim 9, wherein all said frame members have a hollow, rectangularly shaped-cross section.

11. A frame as claimed in claim 10, wherein all said frame members have openings in said upper surface whereby said means for suspension are attached to said frame.

12. A frame as claimed in claim 8, wherein said air permeable material comprises a material selected from the group consisting of alumina sintered material, stainless sintered material, porous glass and FRP.

* * * * *